US005203285A

United States Patent [19]

Tsukino et al.

[11] Patent Number: 5,203,285

[45] Date of Patent: Apr. 20, 1993

[54] UNIFORM DISTRIBUTION HEAT-TRANSFER PIPE UNIT FOR DOUBLE-LAYER FLUIDS

[75] Inventors: Takashi Tsukino; Tadashi Gengo, both of Nagasaki, Japan

[73] Assignee: Mitsubishi Jukogyo Kabushiki Kaisha, Tokyo, Japan

[21] Appl. No.: 716,981

[22] Filed: Jun. 18, 1991

[30] Foreign Application Priority Data

Jun. 18, 1990 [JP] Japan ..... 2-63571[U]

[51] Int. Cl.[5] ..... F28F 7/00

[52] U.S. Cl. ..... 122/6 A; 122/235.12; 122/235.23; 165/145

[58] Field of Search ..... 122/6 A, 235.12, 235.23; 165/144, 145

[56] References Cited

U.S. PATENT DOCUMENTS 962,427 6/1910 Harden ..... 165/144
2,143,287 1/1939 Smith ..... 165/145
3,116,790 1/1964 Walter ..... 165/145
3,842,904 10/1974 Gardenier ..... 165/145
4,387,668 6/1983 Kochey, Jr. ..... 122/6 A

FOREIGN PATENT DOCUMENTS 2557427 6/1977 Fed. Rep. of Germany .
2918835 11/1980 Fed. Rep. of Germany .

*Primary Examiner*—A. Michael Chambers
*Attorney, Agent, or Firm*—Wenderoth, Lind & Ponack

[57] ABSTRACT

In a furnace wall heat-transfer pipe unit in a spiral wound-type boiler, for distributing gas-liquid double layer fluids from lower part spiral pipes to upper vertical pipes, a horizontal pipe is interposed between the spiral pipes and the vertical pipes and extends in a horizontal plane around the furnace wall. The gas-liquid double-layer fluids flow into the vertical pipes via the horizontal pipe extending around the furnace wall from the lower part spiral pipes. Uniform layers of the fluid flow into each vertical pipe so as to minimize an imbalance of fluid temperature at the outlet of the furnace.

2 Claims, 4 Drawing Sheets

FIG. 6(b)
(PRIOR ART)
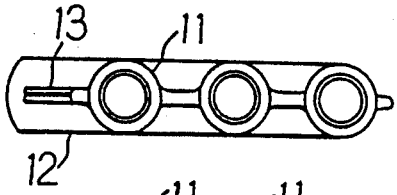
FIG. 6(a)
(PRIOR ART)
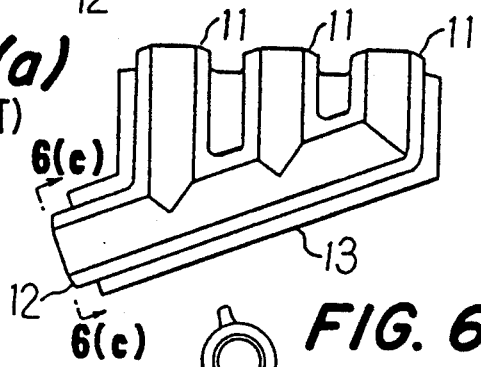
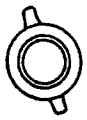
FIG. 6(c)

UNIFORM DISTRIBUTION HEAT-TRANSFER PIPE UNIT FOR DOUBLE-LAYER FLUIDS

BACKGROUND OF THE INVENTION

1. Field of the Invention

The present invention relates to a uniform distribution heat-transfer pipe unit which deals with double-layer fluids along a furnace wall.

2. Description of the Prior Art

In a spiral-wound type furnace variable pressure operation boiler, heat-transfer pipes at the lower part of the furnace extend spirally, whereas at the upper part of the furnace, the heat-transfer pipes extend vertically. The number of the heat-transfer pipes at the upper part is different than that of the pipes at the lower part of the furnace. For this reason, at a junction between the upper and lower parts of the furnace, a branch pipe such as a two-pronged or three-pronged pipe or an intermediate header has been provided to connect the upper and lower pipes.

One example of the prior art will be explained with reference to FIGS. 5 and 6. FIG. 5 shows one example of a spiral-wound type boiler. The boiler comprises a furnace wall pipe unit 10*a* for connecting a lower collecting header 14 to an upper header 15. Spiral pipes 12 are formed at the lower part of this furnace wall pipe unit 10*a*, while vertical pipes 11 are formed at the upper part thereof. For this purpose, the middle of the pipe unit 10*a* is jointed.

FIG. 6 illustrates this joint portion in detail. The number of the upper vertical pipes 11 differs from that of the lower spiral pipes 12, and hence two or three vertical pipes 11 are joined to the single spiral pipe 12. Fins 13 are attached therebetween to keep the furnace airtight.

There arise, however, the following problems inherent in the conventional distribution heat-transfer pipe unit for use with double-layer fluids.

To be specific, the conventional branch (joint) pipe is conceived as a heat-transfer pipe which deals with the double-layer fluids. Therefore, a gas and a liquid are centrifugally separated due to a difference in specific gravity therebetween. Though heat absorption quantities are the same at the upper part (after being branched) of the furnace, temperatures of the pipes occupied mainly by the gases excessively increase, while the pipes occupied mainly by the liquids undergo a smaller rise in temperature by a value equivalent to latent heat. This results in the generation of a large temperature difference therebetween, which may in some cases be a mortal blow to the furnace shaping pipes.

To obviate this problem, there exists an intermediate header system in which a header is interposed between the upper and lower parts of the furnace. Based on this structure, the furnace walls are complicated. This impacts greatly on the manufacturing costs , and makes it difficult to effect a sealing of intra furnace combustion gas.

SUMMARY OF THE INVENTION

It is a primary object of the present invention to obviate all of the problems of the prior art, i.e. to provide a uniform distribution heat-transfer pipe unit for double-layer fluids which is capable of attaining a uniform distribution of the double-layer fluids, has a simple configuration, is low in cost to manufacture and effects a complete sealing of intra furnace gas.

To accomplish the object above according to the invention, a furnace wall heat-transfer pipe unit, for distributing gas-liquid double layer fluids from lower part spiral pipes to a plurality of upper part vertical pipes in a spiral wound-type boiler, is characterized by comprising a horizontal pipe interposed between the spiral pipes and the vertical pipes and by extending in a horizontal plane around the furnace wall.

The present invention therefore exhibits the following effect.

Specifically, internal double-layer fluids flow from the spiral pipes at the lower part of the furnace into a horizontal pipe. The fluids then run in a horizontal direction in the horizontal pipe. The fluids thus circulate along the entire periphery of the furnace. The circulated fluid within the horizontal pipes becomes uniform, and it follows that the fluid is raised in the form of a uniform layer when flowing into the vertical pipes at the upper part of the furnace. The heat is uniformly absorbed at the upper part of the furnace, and no difference in temperature can be seen at the outlet.

The horizontal pipe lies within the same plane as the furnace wall surface. Hence, there is no three-dimensional curved pipe as often seen in the intermediate header system, and the headers can be omitted, resulting in a simple structure. It is therefore possible to remarkably reduce the costs and easily attain complete intra-furnace gas sealing.

BRIEF DESCRIPTION OF THE DRAWINGS

Other objects and advantages of the present invention will become apparent from the following description made in conjunction with the accompanying drawings, in which:

FIGS. 6(*a*), 6(*b*) and 6(*c*) illustrate a portion of a heat-transfer pipe unit encircled by VI in FIG. 5, FIG. 6(*a*) being a vertical sectional view thereof, FIG. 6(*b*) being a plan view thereof and FIG. 6(*c*) being a view thereof taken in the direction of arrows c—c of FIG. 6(*a*).

DETAILED DESCRIPTION OF THE PREFERRED EMBODIMENT

Figure 3:
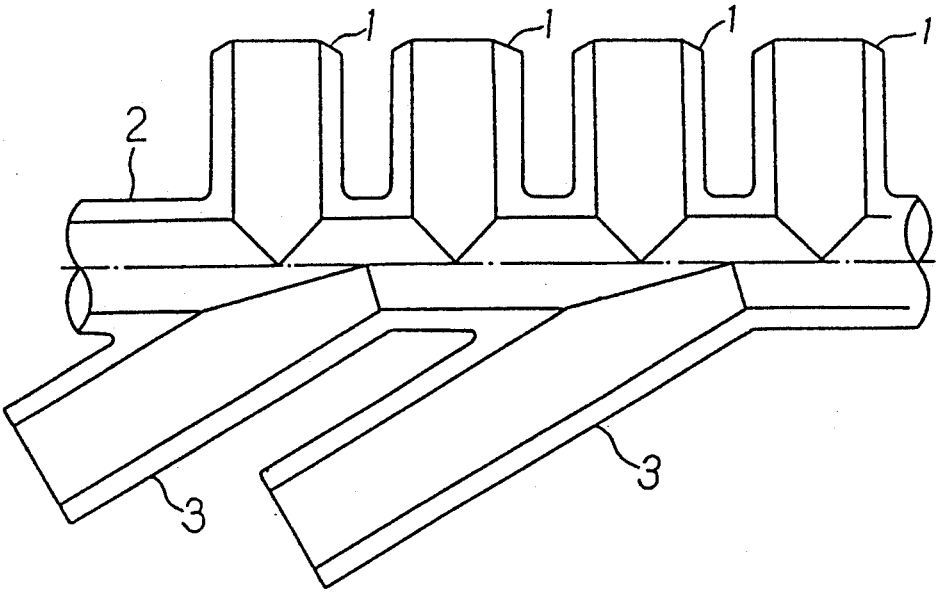
FIG. 3 is a vertical sectional view of a portion of the heat-transfer pipe unit encircled by III in FIG. 4, illustrating a horizontal pipe interposed between spiral pipes and vertical pipes in this embodiment.
Figure 4:
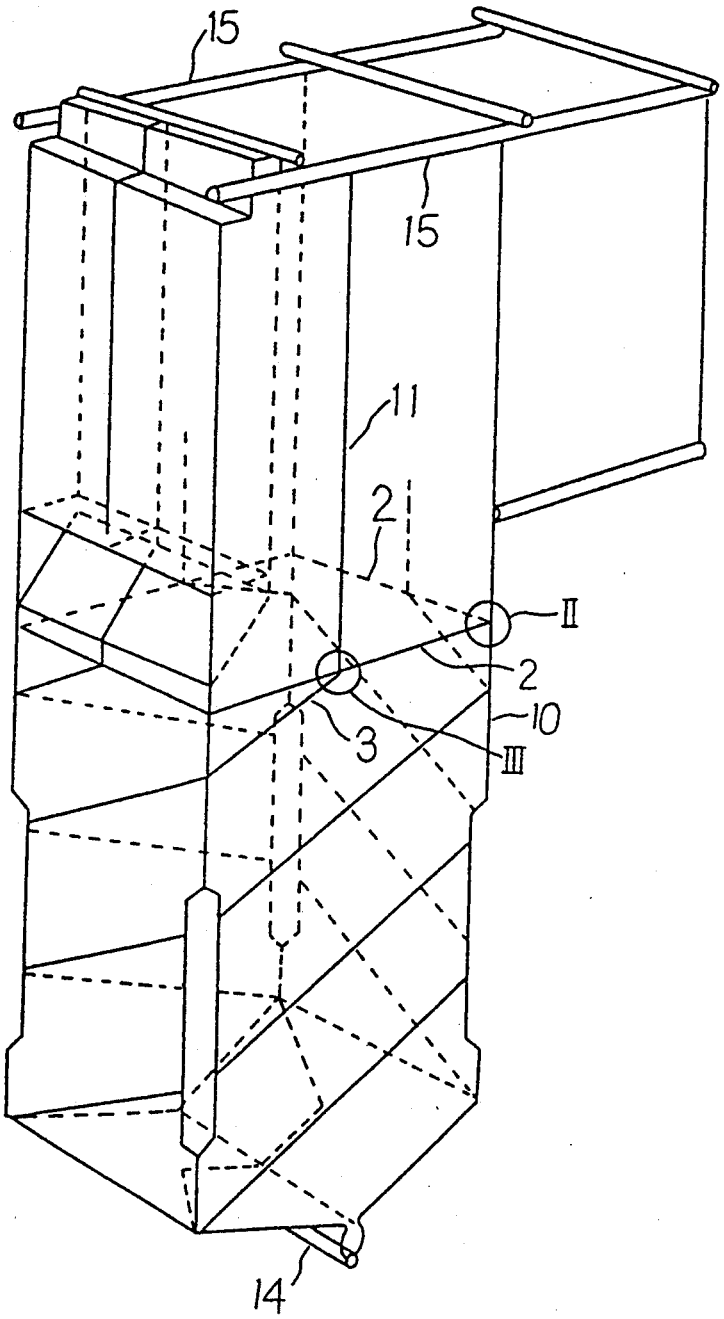
FIG. 4 is a perspective view of a boiler employing the embodiment of a uniform distribution heat-transfer pipe unit for double-layer fluids according to the present invention.
Figure 5:
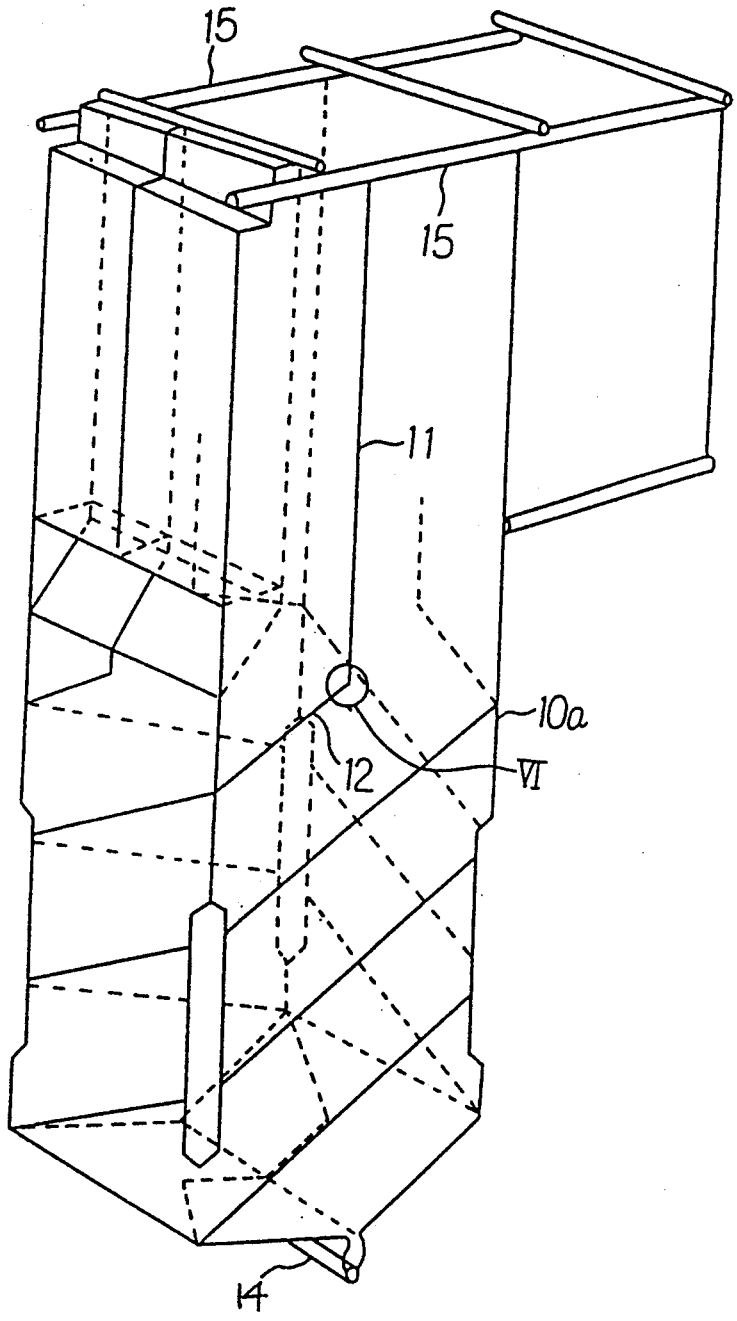
FIG. 5 (PRIOR ART)
FIG. 5 is a perspective view of a conventional boiler.

One embodiment of the present invention will be described with reference to FIGS. 1 through 4. Note that components which are the same as those employed in the conventional boiler shown in FIGS. 5 and 6 are marked with like symbols, and a detailed description thereof will be omitted.

Figure 1:
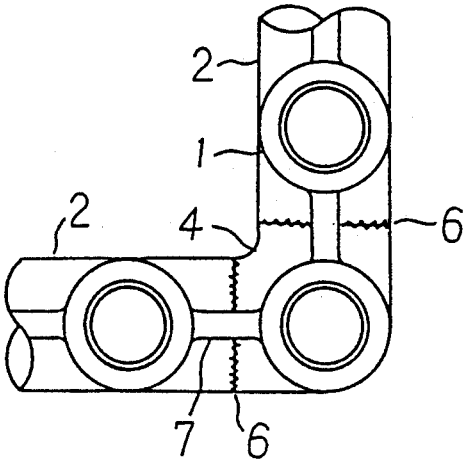
FIG. 1 is a plan view of a furnace wall corner part of an embodiment of a heat-transfer pipe unit in a spiral-wound type variable pressure operation boiler according to the present invention, wherein a vertical pipe is provided at the corner part.
Figure 2:
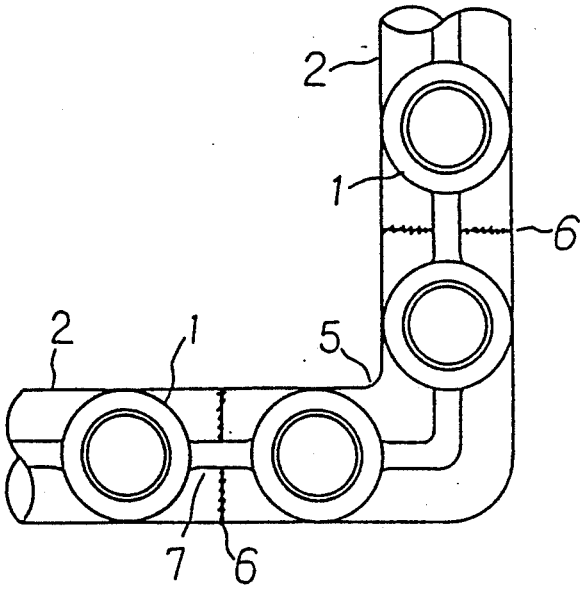
FIG. 2 is a plan view of a portion of a heat-transfer pipe unit encircled by II in FIG. 4, showing a case where no vertical pipe is provided at the corner part.

FIGS. 1 and 2 are detailed plan views each illustrating a horizontally extending furnace wall corner part of a first embodiment of a heat-transfer pipe unit in a spiral-wound type variable pressure operation boiler. FIG. 1 depicts a case where a vertical pipe is provided at the corner part. FIG. 2 illustrates a case where no vertical pipe is provided at the corner part. FIG. 3 is a vertical sectional view of a joint portion of the heat-transfer pipe unit located between the upper and lower parts of the furnace. FIG. 4 is a perspective view of the boiler equipped with the first embodiment of the uniform distribution heat-transfer pipe unit. In these Figures, numeral 2 designates a horizontal pipe to which a plurality of adjacently disposed vertical pipes 1 are joined. Spiral pipes 3 are joined to the lower part of the horizontal pipe 2. This horizontal pipe 2 forms, as shown at the middle part of FIG. 4, part of a furnace wall 10 over the entire periphery of the furnace in a horizontal plane.

The following is a description of the effects associated with the above-described construction.

Double-layer fluids ascending through the spiral pipes 3 enter the horizontal pipe 2 and then circulate therein. Thereafter, the fluids present a gas-liquid distribution averaged over the entire peripheral portion of the furnace wall as provided by the horizontal pipe 2. The fluids flow into the vertical pipes 1, whereby a gas-liquid mixing phase rate in the respective vertical pipes 1 becomes constant. Hence, there is produced no temperature difference, based on a difference in gas-liquid latent heat, between the vertical pipes 1. There is also no possibility of the pipes being exposed to a critical danger. Furthermore, headers are not required. The structure is quiet simple. Therefore, a length (area) of joints formed by welding is small, and correspondingly a frequency at which leakage takes place is small. Gas sealing is facilitated. As a result, there is an advantage in cost savings.

If the vertical pipes 1 are, as illustrated in FIG. 1, provided at the corner part of the furnace wall, the horizontal pipes 2 are joined by a short elbow 4 (having no straight pipe portions). This arrangement provides such a configuration that welded portions 6 do not contact the vertical pipes 1. If no vertical pipes 1 are, as illustrated in FIG. 2, provided at the corner part of the furnace wall, the horizontal pipes 2 are joined by a straight elbow 5 (having straight pipe portions). With this arrangement, the welded portions 6 similarly do not interfere with the vertical pipes 1. Note that numeral 7 represents a fin.

The present invention having the structure discussed above therefore exhibits the following effects.

The branch pipe, which has hitherto been disposed in the middle portion of the furnace wall between the upper and lower parts of the furnace of the spiral-wound type variable pressure operation boiler, is eliminated. Instead, a horizontal pipe serving as the principal component of the heat-transfer pipe unit of this invention lies entirely within a common horizontal plane so as to extend over an entire peripheral portion of the furnace. A circulating flow in the horizontal direction is therefore produced. The double-layer fluids flowing in the upper part of the furnace are made uniform, thereby minimizing an imbalance of fluid temperatures which would otherwise be caused at the outlet of the furnace.

The structure is relatively simple because no intermediate header or the like is employed. The manufacturing costs are therefore low, and a complete gas sealing is attained.

Although the present invention has been described in detail with reference to the accompanying drawings, it is to be understood that the present invention is not limited to the illustrated embodiment. Various changes or modifications may be effected therein by one skilled in the art without departing from the scope or spirit of the invention.

We claim:

1. In a spiral wound type of boiler having a furnace wall, pipes extending spirally around a lower part of the furnace wall, and pipes extending vertically along an upper part of the furnace wall, the improvement wherein a horizontal pipe extends entirely around the periphery of the furnace wall in a horizontal plane, said horizontal pipe being interposed between and opening into the spirally extending and the vertically extending pipes.

2. A furnace wall heat-transfer pipe unit for uniformly distributing a gas-liquid double layer fluid in a spiral wound boiler having a furnace wall, said heat-transfer pipe unit comprising: spirally extending pipes disposed at a lower part of the furnace wall of the boiler, vertically extending pipes disposed at an upper part of the furnace wall of the boiler, and a horizontal pipe extending entirely around the periphery of the furnace wall in a common horizontal plane, said horizontal pipe interposed between and opening into said spirally extending and said vertically extending pipes.

* * * * *